US006095331A

United States Patent [19]

Cressman

[11] Patent Number: 6,095,331

[45] Date of Patent: Aug. 1, 2000

[54] DECORATIVE PACKAGING ARRANGEMENT

[76] Inventor: Stephen C. Cressman, P.O. Box 2113, Largo, Fla. 33779

[21] Appl. No.: 09/348,547

[22] Filed: Jul. 7, 1999

Related U.S. Application Data

[63] Continuation-in-part of application No. 09/092,242, Jun. 5, 1998, abandoned.

[51] Int. Cl.[7] ..... B65D 73/00

[52] U.S. Cl. ..... 206/457; 40/597; 206/217; 206/575; 426/104

[58] Field of Search ..... 206/216, 217, 206/575, 579, 232, 349, 457, 459.5; 473/578, 572; 426/104, 106; 215/386; 211/60.1; 40/597, 606; D11/166, 181

[56] References Cited

U.S. PATENT DOCUMENTS

| | | | |
|---|---|---|---|
| 3,148,856 | 9/1964 | Orlando | 40/597 |
| 5,167,417 | 12/1992 | Stacey et al. | 473/578 |
| 5,450,811 | 9/1995 | Heiland | 40/597 |
| 5,483,916 | 1/1996 | Kolvites et al. | 40/597 |
| 5,874,119 | 2/1999 | Coleman et al. | 426/104 |
| 5,881,481 | 3/1999 | Bashaw, Jr. et al. | 40/597 |

*Primary Examiner*—Paul T. Sewell
*Assistant Examiner*—Luan K. Bui

[57] ABSTRACT

In its broadest context, the packaging arrangement includes a rectangular container with an aperture within its upper surface. An arrow, with a message attached to its intermediate extent, can then be inserted into the container. A suction cup can also be secured to the shaft of the arrow. Thus, the arrow can be taken out of the container and the suction cup secured to its lower extent.

10 Claims, 5 Drawing Sheets

DECORATIVE PACKAGING ARRANGEMENT

RELATED APPLICATION

This application is a continuation-in-part of application Ser. No. 09/092,242 filed Jun. 5, 1998, abandoned.

BACKGROUND OF THE INVENTION

1. Field of the Invention

The present invention relates to a decorative packaging arrangement and more particularly pertains to an arrangement which employs an arrow.

2. Description of the Prior Art

The use of a arrows is known in the prior art. More specifically, such arrows are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,840,598 to Schuetz discloses an amusement projectile device. U.S. Design Patent 268,036 to Cagan discloses a dart design. U.S. Design Patent 266,915 to Metzinger discloses a sculptural air balloon attachment for a gift basket. U.S. Pat. No. 4,030,761 to Daller discloses a dart configuration. U.S. Pat. No. 5,251, 759 to Gannon discloses a gift packaging and wrapping ensemble. U.S. Pat. No. 3,049,059 to Burt discloses a method of forming a collapsed carton blank. U.S. Pat. No. 1,328,967 to Reaben discloses an arrow device.

In this respect, the decorative packaging arrangement of the present invention substantially departs from the conventional concepts and designs of the prior art, and in so doing provides an apparatus primarily developed for sending decorative messages.

Therefore, it can be appreciated that there exists a continuing need for novel decorative packaging arrangements. In this regard, the present invention substantially fulfills this need.

SUMMARY OF THE INVENTION

In view of the foregoing disadvantages inherent in the known types of packaging arrangements now present in the prior art, the present invention provides an arrangement which incorporates an arrow. As such, the general purpose of the present invention, which will be described subsequently in greater detail, is to provide a Valentines Day packaging arrangement.

To attain this, the present invention essentially comprises a decorative packing arrangement. The arrangement includes a package a recipient object. A decorative arrow is provided. The arrow has a distal end, a proximal end. The arrow has an intermediate extent between the distal end and the proximal end. Next provided is a piece of note paper. An attachment component is provided and couples the note paper to the intermediate extent of the arrow. Means are provided to removably couple the arrow remote from the flights, note paper and attachment component with the recipient object.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved decorative packaging arrangement for a confection. The packing arrangement includes a rectangular package having a lower face,. an upper face, and peripheral sidewalls therebetween. The faces and sidewalls define an interior region. A partition is located within the interior region and divides it into a major interior portion and a minor interior portion. An aperture is formed within the upper face of the package and is in communication with the minor interior portion. A decorative arrow is included which has a distal end, a proximal end and an intermediate extent there between. A series of flights are spaced about the distal end of the arrow. Furthermore, a series of ribbons are secured to the distal end of the arrow. A resilient suction cup is included having a conical portion and a cylindrical stem portion, and a transverse aperture formed through the cylindrical stem portion. The proximal end of the arrow has a first orientation wherein the proximal end is positioned through the transverse aperture, and a second orientation wherein the proximal end is secured to the cylindrical stem portion. When the suction cup is in the first orientation, the proximal end of the arrow is positioned within the aperture of the upper face of the rectangular package. A piece of note paper is secured to the intermediate extent of the arrow, and candy is positioned within the major interior portion of the rectangular package.

It is another object of the present invention to provide a packaging arrangement with an associated arrow, wherein the arrow can be removed from the package and used.

It is a further object of the present invention to provide a novel means to send a written message.

An even further object of the present invention is to provide a packaging arrangement which is susceptible of a low cost of manufacture with regard to both materials and labor, and which accordingly is then susceptible of low prices of sale to the consuming public, thereby making such packaging arrangements more economically available to the buying public.

Still another object of the present invention is to provide a novel container for candy and the like.

Yet another object of the present invention is to provide a decorative packaging arrangement which includes a recipient object; a decorative arrow having a distal end, a proximal end and an intermediate extent there between; a piece of note paper; an attachment component coupling the note paper to the intermediate extent of the arrow; and means removably coupling the arrow remote from the flights, note paper and attachment component with the recipient object.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
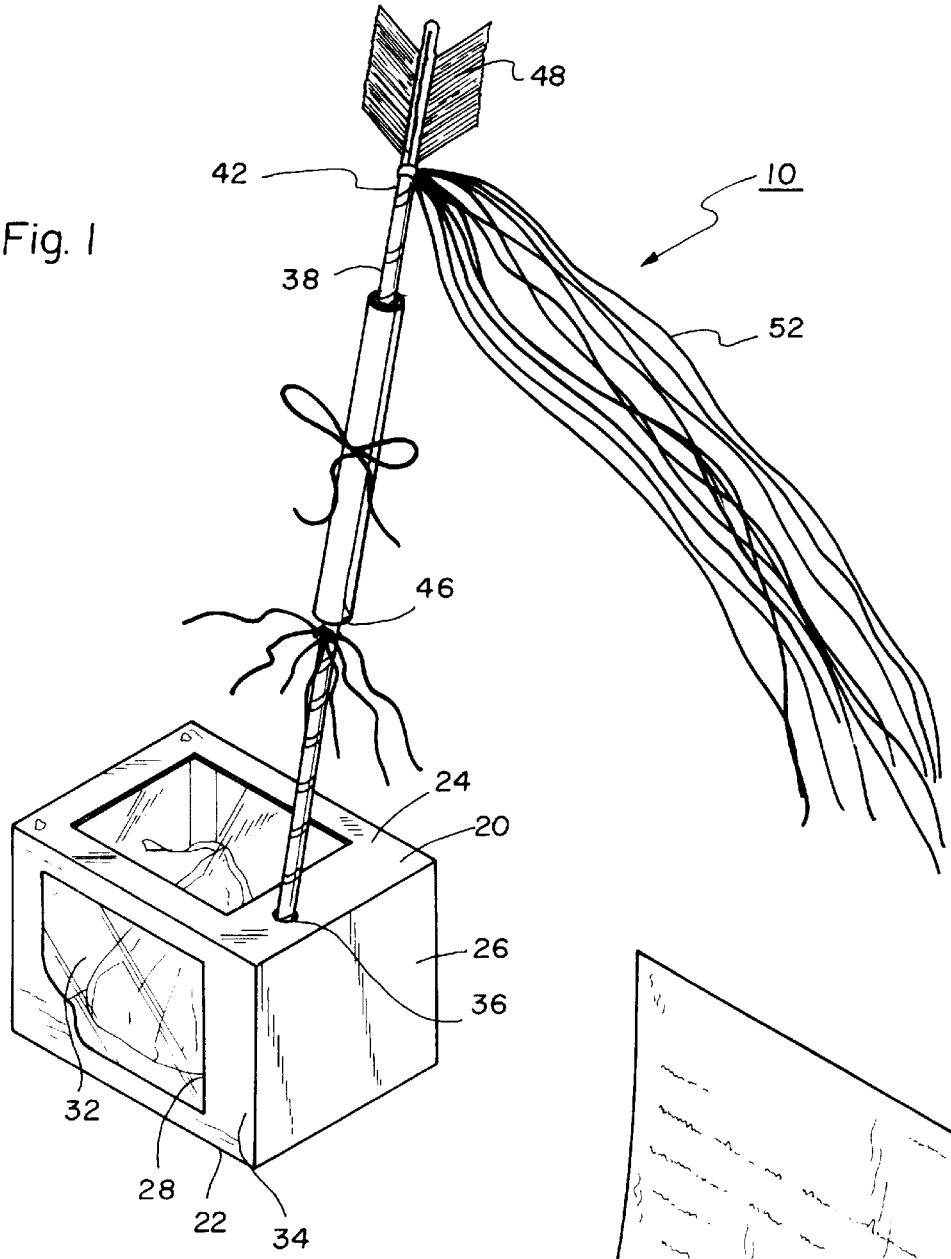
FIG. 1 is a perspective view of the packaging arrangement of the present invention.
Figure 2:
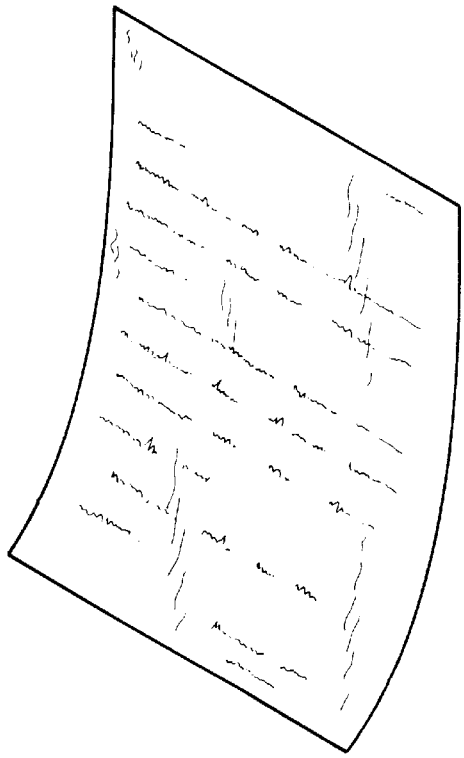
FIG. 2 is an illustration of a note which can be secured to the arrow shaft.

With reference now to the drawings, and in particular to FIG. 1 thereof, the decorative packaging arrangement of the present invention is depicted. In its broadest context, the packaging arrangement includes a rectangular container with an aperture within its upper surface. An arrow, with a message attached to its intermediate extent, can then be inserted into the container. A suction cup can also be secured to the shaft of the arrow. Thus, the arrow can be taken out of the container and the suction cup secured to its lower extent. The various components of the present invention, and the manner in which they interrelate, will be described in greater detail hereinafter.

The decorative packaging arrangement 10 is adapted to contain a confection or the like. The rectangular package 20 is defined by a lower face 22, an upper face 24, and peripheral sidewalls 26 therebetween. The faces and sidewalls serve to define an interior region. A partition 28 located within the interior region divides the region into a major interior portion 32 and a minor interior portion 34. Candy is adapted to be positioned within the major interior portion 32 of the package 20. Additionally, an aperture 36 is formed within the upper face 24 of the package 20 and is in communication with the minor interior portion 34.

With reference to FIG. 1, the manner in which the decorative arrow 38 is secured within the container is illustrated. The decorative arrow 38 is defined by a distal end 42, a proximal end 44 and an intermediate extent 46 therebetween. As is conventional in arrows, a series of flights 48 are spaced about the distal end 42 of the arrow 38. Additionally, in order to increase the decorative nature of the arrow, a series of ribbons 52 are secured to its distal end 42.

Figure 5:
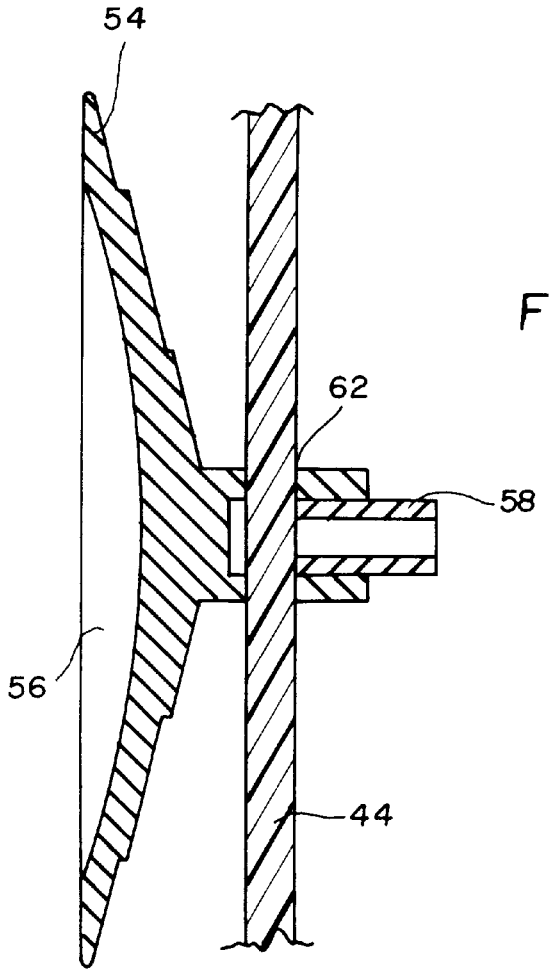
FIG. 5 is a cross section taken along line 5—5 of FIG. 4.

With reference to FIG. 5, the resilient suction cup 54 of the present invention is depicted. This resilient suction cup 54 is defined by a conical portion 56, a cylindrical stem portion 58, and a transverse aperture 62 which is formed through the cylindrical stem 58. The proximal end 44 of the arrow 38 has a first orientation wherein the proximal end 44 is positioned through the transverse aperture 62. The proximal end 44 also has a second orientation wherein the proximal end 44 is secured to the cylindrical stem portion 58. Thus, when the suction cup is in the first orientation, the proximal end 44 of the arrow 38 can be positioned within the aperture 36 of the upper face 24 of the rectangular package 20. This is the arrangement depicted in FIG. 3.

Figure 6:
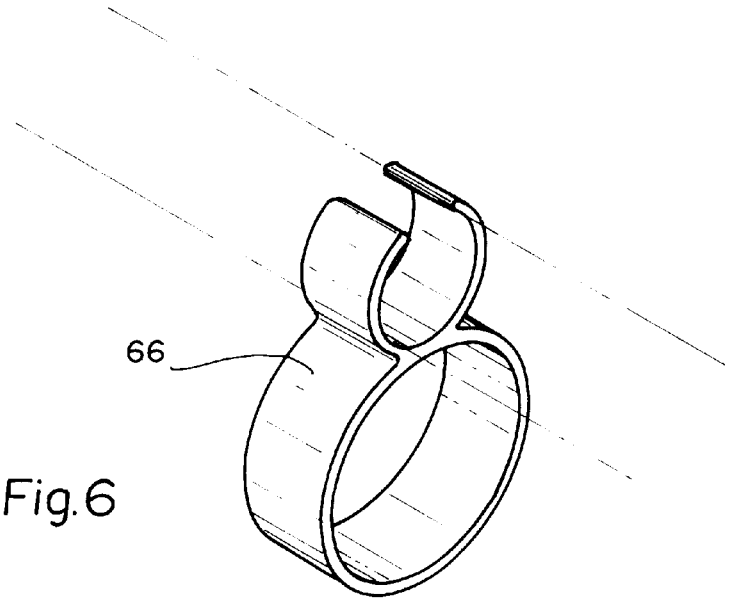
FIG. 6 is a view of the note clip of the present invention.

A piece of note paper 64 can be secured to the intermediate extent 46 of the arrow 38. This note paper 64 can contain a personal note from the person giving the decorative packaging arrangement 10. In the preferred embodiment, the note 64 is tied to the central extent of the arrow by a piece of ribbon. In an alternative embodiment a note holding clip 66 is positioned upon the central extent 46 of the arrow shaft. This clip 66 has a first U-shaped shaft engaging portion, and a second circular note holding portion. The clip of the alternative embodiment is depicted in FIG. 6.

Alternate embodiments of the invention are shown in FIGS. 7 through 10. Like the first embodiment, each alternate embodiment is a decorative packaging arrangement. Each comprises in combination a recipient object. Such recipient object may be the box of the primary embodiment or a vase of FIG. 7, a cup of FIG. 8, a bottle of FIG. 9 or a stuffed animal of FIG. 10.

Figure 3:
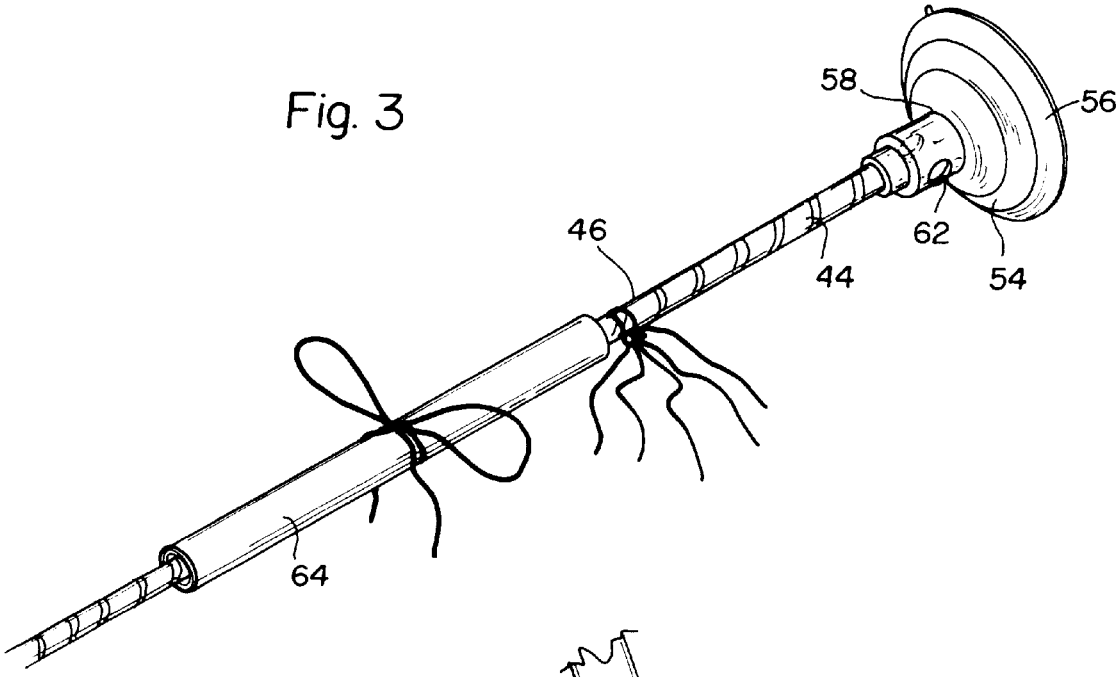
FIG. 3 is a perspective view of the arrow with suction cup attached.
Figure 4:
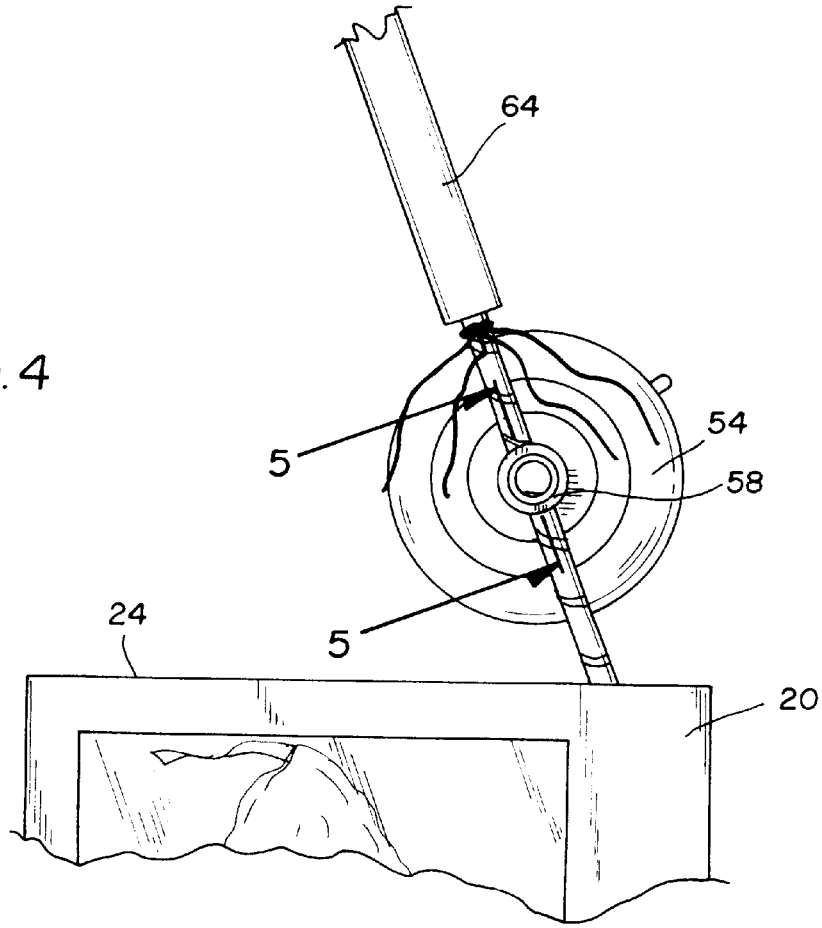
FIG. 4 is a view of the suction cup secured to the arrow shaft.

In each embodiment, there is a decorative arrow. Each such arrow has a distal end, a proximal end and an intermediate extent there between. Each such embodiment includes a piece of note paper, preferably wrapped into a tubular configuration and an attachment component for coupling the note paper to the intermediate extent of the arrow. The attachment component may be a string as shown in FIGS. 1 and 3 or a clip as shown in FIG. 6–10. Lastly, each embodiment includes some structural means for removably coupling the arrow with the recipient object.

In the embodiment of FIGS. 1–4, the recipient object is a candy box 20 and the means to removably couple the arrow to the candy box is an aperture 36 in the upper surface of the box and the bottom 70 of the box supporting the arrow tip 72.

Figure 7:
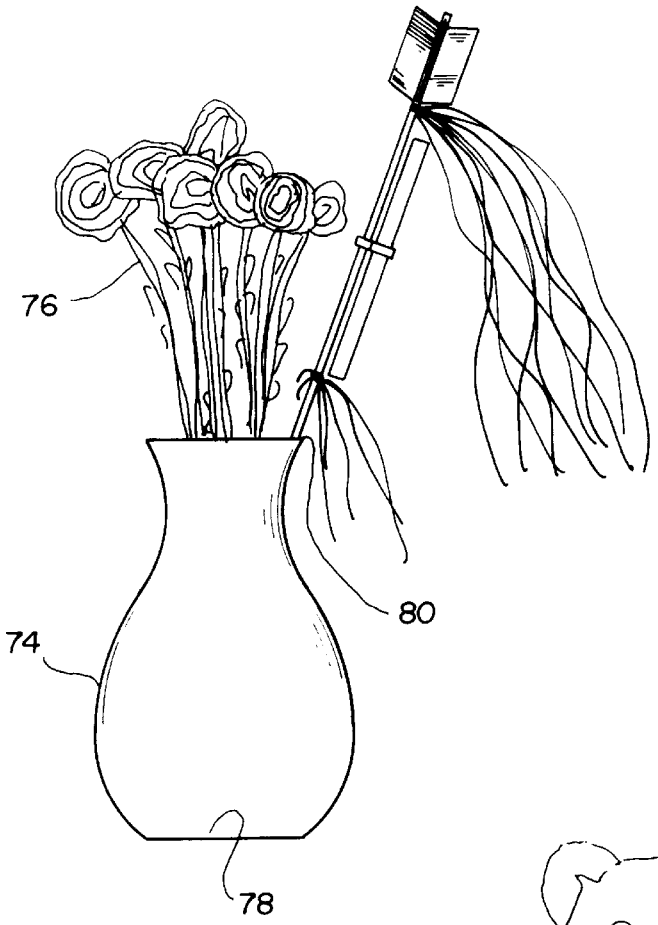
FIG. 7 through 10 illustrate alternate embodiments of the invention.

In the FIG. 7 embodiment, the recipient object is a vase 74 preferably also supporting flowers 76. The means to removably couple the arrow to the vase is the bottom of the vase 78 receiving the tip 72 of the arrow and the lip 80 of the vase receiving an intermediate portion of the arrow, and providing a lateral support.

Figure 8:
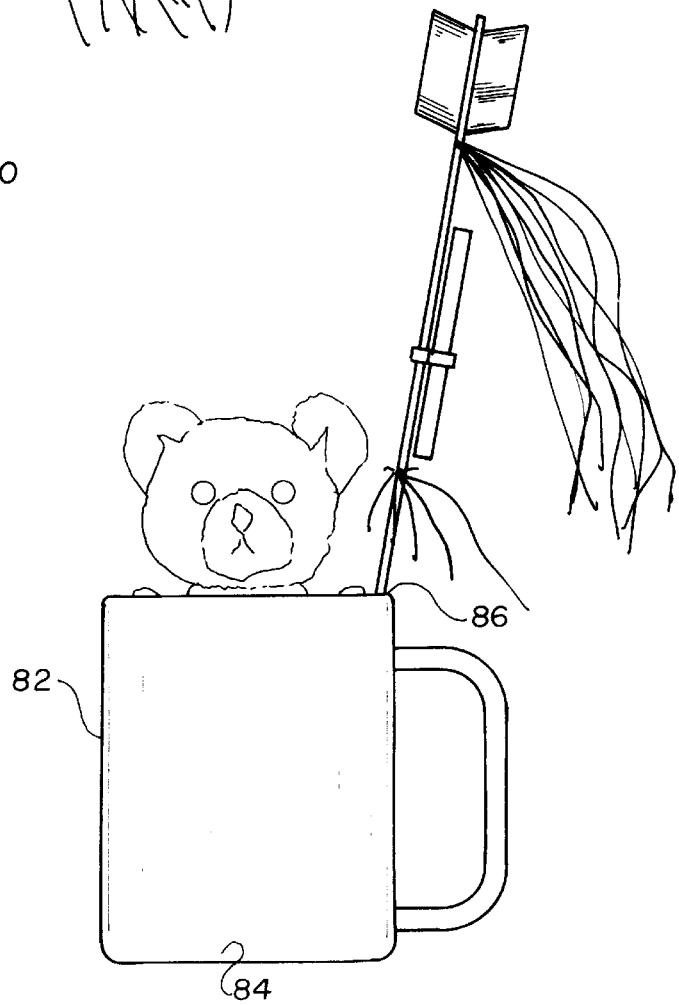

FIG. 8 illustrates an embodiment wherein the recipient object is a mug 82 while the means to removably couple the arrow to the mug is the bottom 84 of the mug receiving and supporting the tip 72 of the arrow in association with the lip 86 of the mug which supports an intermediate portion of the arrow as shown.

Figure 9:
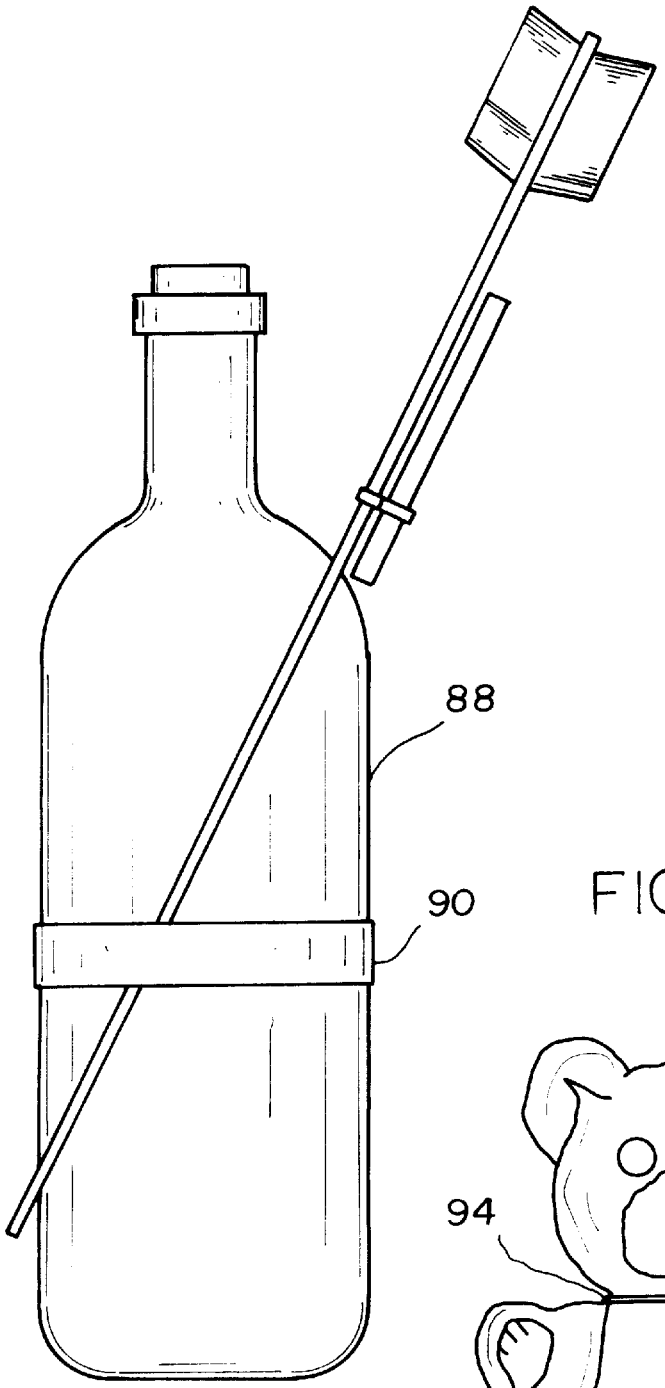

The FIG. 9 embodiment features a bottle 88, preferably a wine, champagne, or similar bottle, as the recipient object. The means to removably couple the arrow remote form the flights is preferably a band 90. As a substitute for the band, an adhesive ribbon, a ribbon tie, a plastic tie, or a rubber band could be employed.

Figure 10:
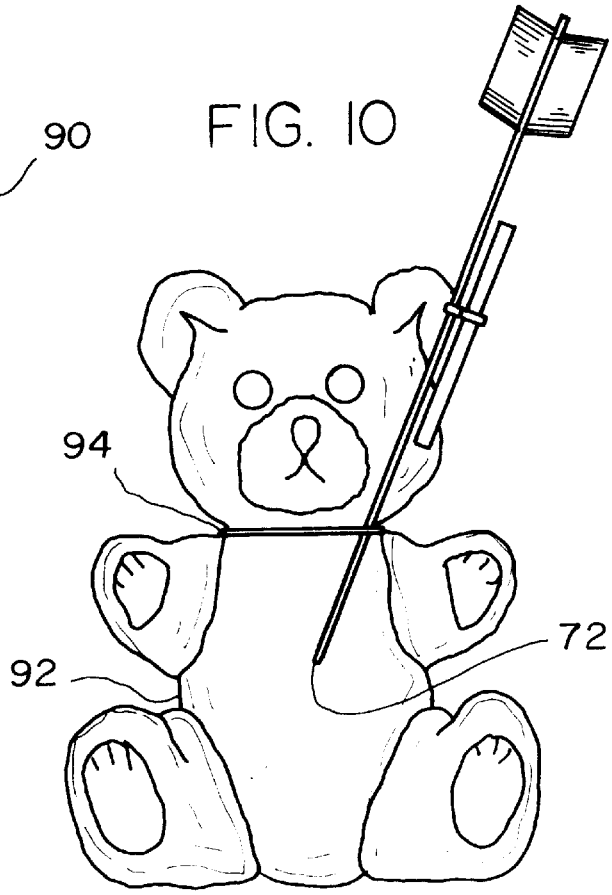

Lastly, in the FIG. 10 embodiment, the recipient object is a stuffed animal 92. The means to removably couple the arrow to the stuffed animal is a collar 94 around the neck of the animal. The arrow has an intermediate extent positioned between the stuffed animal and the collar. It is preferred that the end of the arrow is blunt for safety purposes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the united states is as follows:

1. A decorative packaging arrangement for a confection, the packing arrangement comprising in combination:

a rectangular package having a lower face, an upper face, and peripheral sidewalls therebetween, the faces and sidewalls defining an interior region, a partition located within the interior region and dividing the interior region into a major interior portion and a minor interior portion, an aperture formed within the upper face of the package and in communication with the minor interior portion;

a decorative arrow having a distal end, a proximal end and an intermediate extent therebetween, a series of flights spaced about the distal end of the arrow, a series of ribbons secured to the distal end of the arrow;

a resilient suction cup having a conical portion and a cylindrical stem portion, a transverse aperture formed through the cylindrical stem portion, the proximal end of the arrow having a first orientation wherein the proximal end is positioned through the transverse aperture, and a second orientation wherein the proximal end is secured to the cylindrical stem portion;

when the suction cup is in the first orientation, the proximal end of the arrow is positioned within the aperture of the upper face of the rectangular package;

a piece of note paper secured to the intermediate extent of the arrow;

candy positioned within the major interior portion of the rectangular package.

2. A decorative packing arrangement comprising in combination:

a package having a lower face, an upper face, and peripheral sidewalls therebetween, the faces and sidewalls defining an interior region, an aperture formed within the upper face of the package;

a decorative arrow having a distal end, a proximal end and an intermediate extent therebetween;

a resilient suction cup having a conical portion and a cylindrical stem portion, a transverse aperture formed through the cylindrical stem portion, the proximal end of the arrow having a first orientation wherein the proximal end is positioned through the transverse aperture, and a second orientation wherein the proximal end is secured to the cylindrical stem portion;

when the suction cup is in the first orientation, the proximal end of the arrow is positioned within the aperture of the upper face of the rectangular package.

3. The decorative packing arrangement as described in claim 2 further comprising:

a piece of note paper secured to the intermediate extent of the arrow; and candy positioned within the interior region of the package.

4. The decorative package as described in claim 2 further comprising:

a series of flights spaced about the distal end of the arrow; and a series of ribbons secured to the distal end of the arrow.

5. A decorative packaging arrangement comprising in combination:

recipient object;

a decorative arrow having a distal end, a proximal end with flights there adjacent and an intermediate extent there between;

a piece of note paper;

an attachment component coupling the note paper to the intermediate extent of the arrow; and means removably coupling the arrow with the recipient object with the recipient object in contact with the intermediate extent of the arrow.

6. The decorative packaging arrangement as set forth in claim 5 wherein the recipient object is a box with an upper surface and a bottom and the means to removably couple the arrow to the box is an aperture in the upper surface of the box and the bottom of the box.

7. The decorative packaging arrangement as set forth in claim 5 wherein the recipient object is a vase and the means to removably couple the arrow to the vase with an upper lip is the bottom of the vase receiving the distal end of the arrow and the lip of the vase receiving an intermediate extent of the arrow.

8. The decorative packaging arrangement as set forth in claim 5 wherein the recipient object is a mug with a bottom and with a top having a lip and the means to removably couple the arrow to the mug is the bottom of the mug receiving the distal end of the arrow and the lip of the mug receiving an intermediate extent of the arrow.

9. The decorative packaging arrangement as set forth in claim 5 wherein the recipient object is a bottle and the means to removably couple the arrow remote from the flights is a rubber band.

10. The decorative packaging arrangement as set forth in claim 5 wherein the recipient object is a plush toy with a neck and the means to removably couple the arrow to the plush toy is a collar around the neck of the plush toy receiving the intermediate extent of the arrow.

* * * * *